US009108423B2

(12) United States Patent
Nicholson, III et al.

(10) Patent No.: US 9,108,423 B2
(45) **Date of Patent: *Aug. 18, 2015**

(54) CONSUMABLE SUPPLY ITEM WITH FLUID SENSING FOR MICRO-FLUID APPLICATIONS

(75) Inventors: Marvin Nicholson, III, Lexington, KY (US); Jason McReynolds, Georgetown, KY (US); Robert Muyskens, Lexington, KY (US); Mark Doerre, Lexington, KY (US); Ricky Robbins, Danville, KY (US); Daivd Ward, Lexington, KY (US)

(73) Assignee: Funai Electric Co., Ltd. (JP)

( * ) Notice: Subject to any disclaimer, the term of this patent is extended or adjusted under 35 U.S.C. 154(b) by 114 days.

This patent is subject to a terminal disclaimer.

(21) Appl. No.: 13/149,154

(22) Filed: May 31, 2011

(65) Prior Publication Data

US 2012/0306973 A1 Dec. 6, 2012

(51) Int. Cl.
*B41J 2/175* (2006.01)

(52) U.S. Cl.
CPC .... *B41J 2/17566* (2013.01); *B41J 2002/17579* (2013.01)

(58) Field of Classification Search
USPC ..... 347/7, 19, 86; 399/29, 35
See application file for complete search history.

(56) References Cited

U.S. PATENT DOCUMENTS 755,231 A * 3/1904 Lanman ..... 280/137.504
3,929,071 A 12/1975 Cialone
4,201,085 A 5/1980 Larson
4,318,114 A 3/1982 Huliba
4,403,227 A 9/1983 Bertschy
4,415,886 A 11/1983 Kyogoku
4,719,475 A 1/1988 Kiyohara
4,853,718 A 8/1989 ElHatem
5,289,211 A 2/1994 Morandotti
5,635,962 A 6/1997 Goldis
5,682,184 A 10/1997 Stephany
5,724,076 A * 3/1998 Ishida ..... 347/7
5,751,322 A 5/1998 Miller
5,788,388 A 8/1998 Cowger
5,997,121 A 12/1999 Altfather
6,203,147 B1 3/2001 Battey
6,312,113 B1 11/2001 Murad
6,631,983 B2 10/2003 Romano, Jr.

(Continued)

OTHER PUBLICATIONS

Phillips, DW; Capacitive Ink Level Detector, IBM Technical Disclosure Bulletin; Mar. 1974, pp. 3293 and 3294; vol. 16, No. 10.

*Primary Examiner* — Matthew Luu
*Assistant Examiner* — Lily Kemathe
(74) *Attorney, Agent, or Firm* — Amster, Rothstein, Ebenstein LLP

(57) ABSTRACT

A consumable supply item for an imaging device holds an initial or refillable volume of ink. A housing defines an interior having a pair of opposed electrodes. The electrodes have a capacitance that varies in response to an amount of liquid between them. A controller energizes one electrode and receives an output reading from the other. The controller processes the reading on board the housing and supplies it as a digital data stream to the imaging device during use. A memory stores calibration values for an empty and full housing. The controller writes back to the memory present fluid levels obtained from the output reading of the electrode. An enable output allows operation or not of a fluid pump in the imaging device. Materials, construction, modularity, and fluid communication ports are further embodiments, to name a few.

18 Claims, 5 Drawing Sheets

(56) References Cited

U.S. PATENT DOCUMENTS

| | | | | |
|---|---|---|---|---|
| 6,670,817 | B2 * | 12/2003 | Fournier et al. | 324/662 |
| 6,742,872 | B2 | 6/2004 | Fukazawa | |
| 6,817,705 | B1 | 11/2004 | Crockett | |
| 6,862,652 | B1 * | 3/2005 | Tsuji | 711/103 |
| 7,370,528 | B2 | 5/2008 | Scardovi | |
| 7,416,293 | B2 | 8/2008 | Langford | |
| 7,510,257 | B2 | 3/2009 | Jung | |
| 7,555,231 | B2 * | 6/2009 | Etter et al. | 399/35 |
| 7,780,281 | B2 * | 8/2010 | Hashimoto | 347/86 |
| 7,850,295 | B2 * | 12/2010 | Hashimoto | 347/86 |
| 2007/0211088 | A1 * | 9/2007 | Hashimoto | 347/7 |
| 2009/0033693 | A1 * | 2/2009 | Tanaka | 347/7 |
| 2009/0066749 | A1 * | 3/2009 | Young et al. | 347/36 |
| 2009/0160886 | A1 | 6/2009 | McReynolds | |
| 2009/0167809 | A1 * | 7/2009 | Kondo | 347/19 |
| 2013/0083136 | A1 * | 4/2013 | Govyadinov et al. | 347/85 |

* cited by examiner 11
10-c
10-m
10-y
10-k
45
43
57
57
12
25

12
14
35
10
13
11
25
45
33
43
29
39
39
39
37
41
57
57
57
57

Present fluid level
t
16
14
33
52
37
50
12
G

CONSUMABLE SUPPLY ITEM WITH FLUID SENSING FOR MICRO-FLUID APPLICATIONS

FIELD OF THE INVENTION

The present invention relates to micro-fluid applications, such as inkjet printing. The invention relates particularly to detecting fluid levels in supply items consumed in micro-fluid applications. Capacitive sensing with on board processing facilitates designs.

BACKGROUND

The art of printing images with micro-fluid technology is relatively well known. A disposable or (semi)permanent ejection head has access to a local or remote supply of fluid (e.g., ink). The fluid ejects from an ejection zone to a print media in a pattern of pixels corresponding to images being printed. Accurately knowing fluid levels in supply items aids printing.

Yet, as printing evolves away from individual dedicated printers toward workgroup environments, users no longer man printers and note supply item volumes. If ink levels are incorrectly reported, network users potentially print pages before realizing empty supply items require replacement. Incorrect reporting also leads potentially to "dry firing" the ejection head and ingesting air in fluidic channels.

Also, ejection heads are now commonly separated from their ink source. While this helps reduce consumer costs by avoiding the repeated sale of silicon chips, and allows consumption of larger volumes of ink with fewer instances of replenishment, it necessitates the ink source to maintain some form of identification that it can report to printers. In turn, printers use the information to ascertain fluid levels, such as by counting algorithms in firmware that note drops ejected, firing commands initiated or other factors such as fluid evaporation over time. Printers notify users through sensors or display messages that their supply item is empty or nearing empty. Over the years, these algorithm schemes have ranged from slightly incorrect to exceptionally faulty. They have also proven ineffective upon fluid refilling. Users regularly ignore their results and warnings.

Still other detection schemes sense fluid by means of capacitors, optics, weight, ultrasound, magnets, floats, torque sensors, electrical probes, or the like. Many require some form of stimulus external to the supply item. The latter adversely complicates control systems between supplies and their corresponding printers. Many also involve one or more of the following: complex calibration schemes; process to ascertain variations in printer electronics and cabling tolerances; noisy signals resultant from lengthy conductive traces and remotely located circuit components; and inability to move supply items from one printing device to a next.

Accordingly, a need exists in the art to improve fluid level detection in supply items of imaging devices. The need extends not only to improving accuracy, but to simplicity in complex networked environments. Economic advantage is still another consideration. Additional benefits and alternatives are also sought when devising solutions.

SUMMARY

The above-mentioned and other problems become solved with consumable supply items having fluid sensing for micro-fluid applications. The supply item determines fluid levels with capacitive sensing and undertakes on board signal processing. It supplies the processed signal to an imaging device for accurate tracking of supply item fluid levels. No longer do imaging devices conduct processing operations and current fluid levels can remain fixed with the supply item as it travels from one device to the next as necessary. The supply item is also tightly calibrated to remove variability in electronic components and cables, or the like.

In a representative embodiment, the supply item holds an initial or refillable volume of ink. Its housing defines an interior having a pair of opposed electrodes. The electrodes define a capacitance that varies in response to an amount of liquid between them. A controller energizes one electrode and receives an output reading from the other. The controller processes the reading on board the housing and supplies it as a digital data stream to the imaging device during use.

Processing of the signal includes amplification, filtering, synchronization, and analog to digital conversion, among others, and is undertaken with compact analog circuit components. It improves signal to noise ratios over conventional techniques. A memory stores calibration values for an empty and full housing. The imaging device correlates the calibration values to a present output reading of the supply item to accurately know present fluid levels or identify tilt (improper installation) of the supply item. The controller writes back to the memory present fluid levels obtained from the output reading of the electrode.

In other embodiments, the controller defines an enable output to allow operation or not of a fluid pump in the imaging device. In this manner, the pump only operates if the supply item is properly installed, has fluid and is not otherwise tilted out of position. It prevents de-priming ejection printheads, dry firing the heads, spilling over ink, and operating fluid pumps without fluid.

In still other embodiments, a modular construction contemplates a front piece attached to the housing. The piece co-locates the electrodes, controller, and memory and provides interfaces for communicating with the imaging device. Interfaces include, but are not limited to, a digital data stream output corresponding to the present fluid level reading and a pump enable. The front piece also contemplates construction with polypropylene or polyethylene materials that over coat electrodes of tin-plated steel. The piece welds to a front opening of the housing to vertically orient the electrodes to detect fluid in the housing interior. The electrodes extend from the coating in at least two locations. A first location is used to grasp the electrodes during the coating process, while the second location is used to energize the electrodes or receive its output reading during use. The front piece also locates communication ports for the transfer of fluid back and forth to the imaging device and to provide a source of air for overcoming backpressure. The front piece also defines a common size that can fit on any sized housing to allow varying fluid volumes in differing imaging operations. The front piece and/or housing may include still other structures useful in fluid mechanics, such as venting openings, valves, filters, standpipes, fittings, etc.

These and other embodiments are set forth in the description below. Their advantages and features will be readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, methods and apparatus include consumable supply items having fluid sensing for micro-fluid applications, such as inkjet printing, medicinal delivery, forming circuit traces, misting water, etc.

Figures 1A, 1B, 1C:
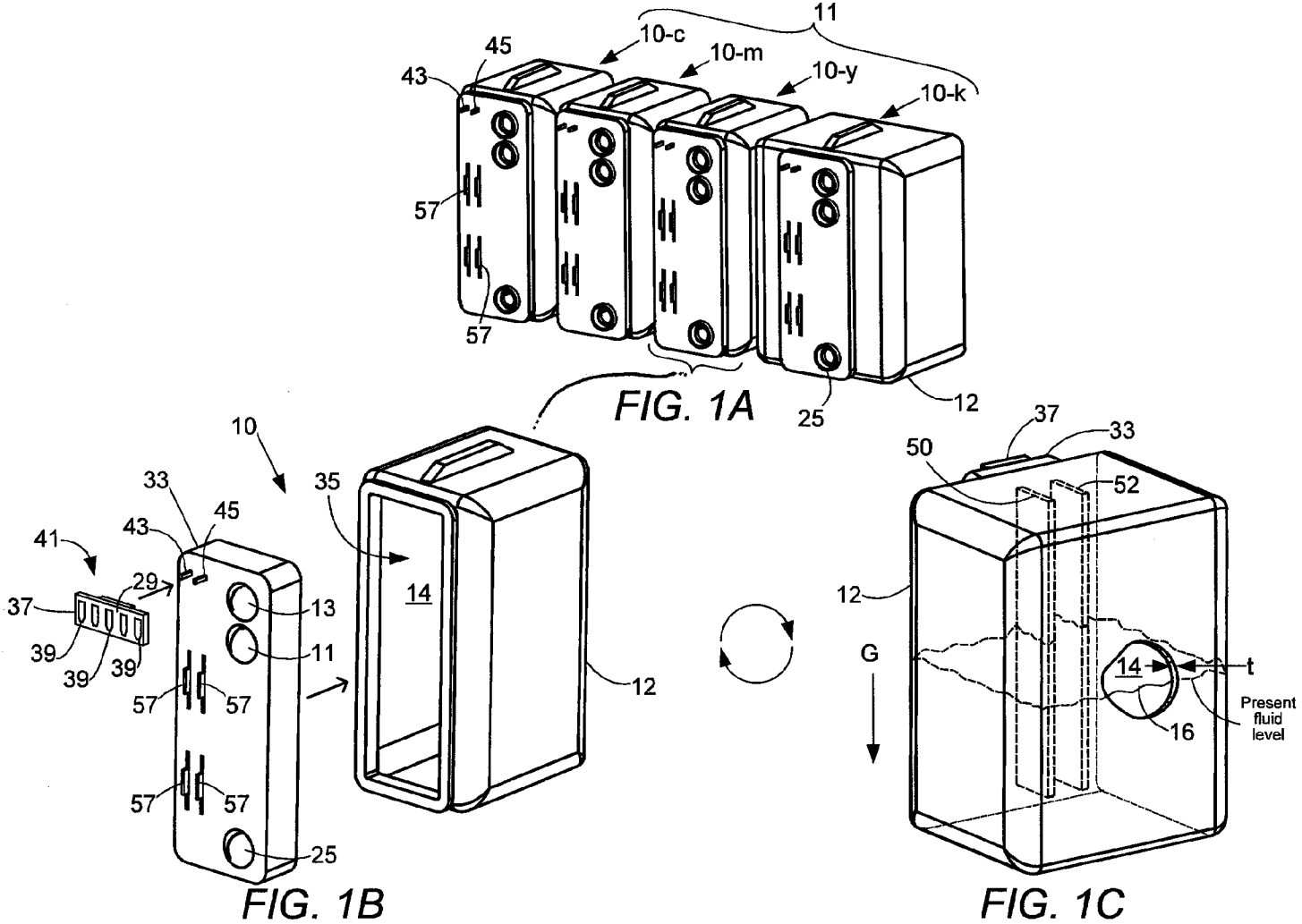
FIGS. 1A, 1B and 1C are diagrammatic views of consumable supply items in accordance with the present invention.

With reference to FIGS. 1A-1C, a supply item 10 has contents consumed in an imaging device. A housing 12 defines an interior 14 containing an initial or refillable supply of fluid, such as ink 16. The ink is delivered to the imaging device by a port, such as septum 25. The port is on a downward side of the housing as the fluid depletes in the direction of gravity G over time. Ports 11 and 13 define locations for fluid return to the housing, in designs contemplating fluid recirculation, and a source of air ingestion to overcome backpressure. The ink is a variety of aqueous inks, such as those based on dye or pigmented formulations. It also typifies color, such as cyan (c), magenta (m), yellow (y), black (k), etc. The ink can be filled in the supply item one per housing, such as 10-*c*, 10-*m*, 10-*y*, 10-*k* in an array 11 of supply items in a multi-color imaging device, or many inks per one housing, not shown.

The housing material is any of a variety for holding fluid. It comprises glass, plastic, metal, etc. Techniques for producing the housing envision blow molding, injection molding, etc. as well as welding, heat-staking, gluing, tooling, etc. Selecting the materials and designing the production, in addition to ascertaining conditions for shipping, storing, use, etc., includes further focusing on criteria, such as costs, ease of implementation, durability, leakage, and the like.

The overall shape of the housing is varied. It is dictated by an amount of fluid to be retained and good engineering practices, such as contemplation of the larger imaging context in which the housing is used. In the design given, the housing is generally rectangular and sits vertically upright. It holds a volume of ink on the order of about 450 ml in a container defining a capacity of about 500 ml. It has a height of about 120 mm. In smaller designs having the same height, the ink volume is about 150 ml in a capacity of about 180-190 ml.

The walls of the housing have a thickness "t." They are generally the same thickness everywhere about an entirety of the housing. They are sufficiently strong to maintain the shape of the housing throughout a lifetime of usage. They are rigid enough to preventing bowing, tilting and the like. They are not overly thick to waste material. The thickness ranges from about 1.0 to about 2.0 mm. The walls may be also formed as a unitary structure in a single instance of manufacturing or as pieces fitted together from individual parts. The latter envisions a modular construction.

Figure 2:
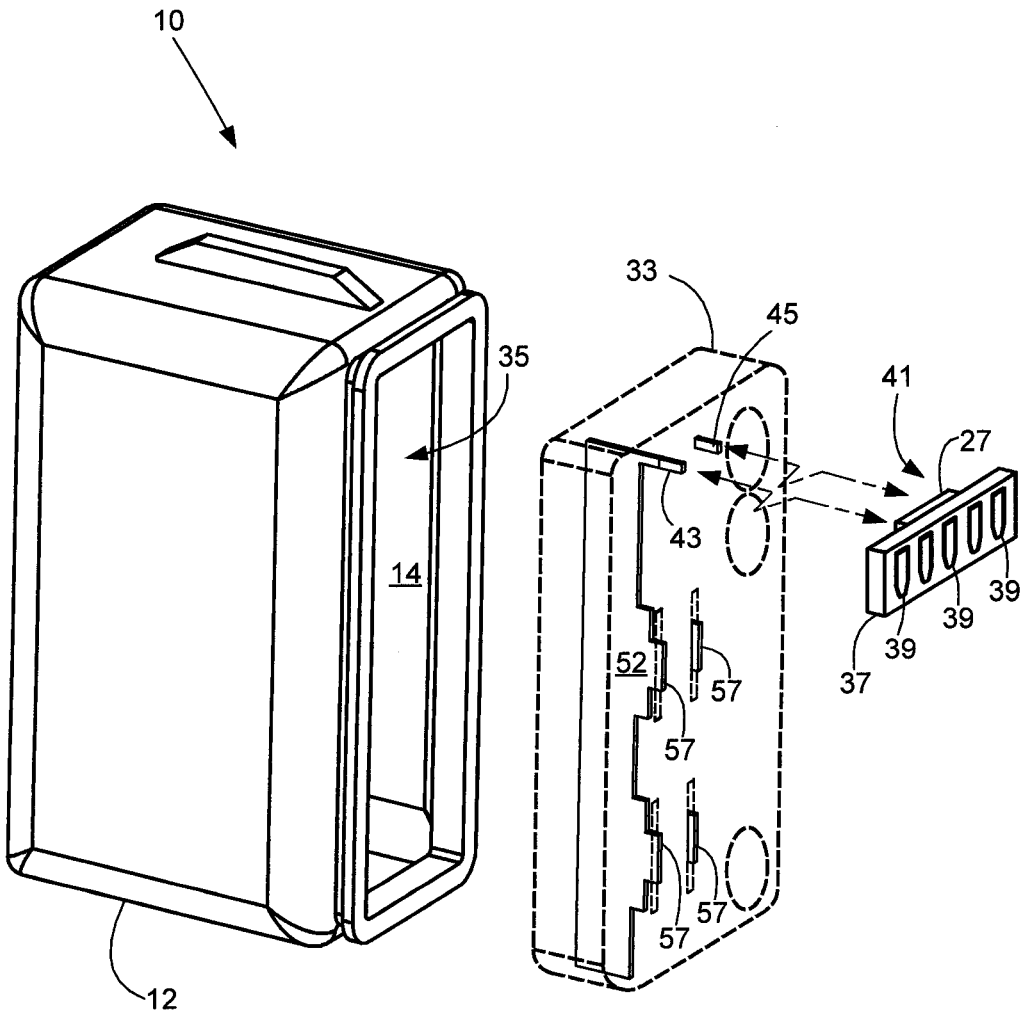
FIG. 2 is a diagrammatic view of an electrode for use in the supply item.

In other modular constructions, a front piece or nose piece 33 is contemplated to weld close an opening 35 of the housing. In this way, the volume and size of the housing can be made variable, while the nose piece can provide a constant interface to an imaging device. It enables the size of the housing walls to vary as demand dictates, but overall manufacturing only changes by the amount necessary to make the walls different sizes. The construction of the nose piece, ports and tooling remains the same from one product offering to the next. This saves costs while allowing many differently sized products. The interface also includes a circuit board 37 attached to the nose piece to conduct on board processing. It has a front side 29 defining conductive pads 39 for electrically communicating to an imaging device. It has a backside 41 defining locations for a controller 27 and other electronic components, as necessary, for signal processing aboard the supply item 10 (see also FIG. 2).

In either the modular or integral design, the housing supports a pair of opposed electrodes 50, 52. They are situated to detect a fluid level in the housing. They are conductive plates whose capacitance varies upon the application of electrical energy according to an amount of liquid that exists between the electrodes. With greater amounts of fluid, the plates have a greater amount of capacitance. With lesser amounts of fluid, the plates have a lesser amount of capacitance. The plates are generally parallel and are distanced from one another in a range of about 4 to about 10 mm.

The plates are also steel plates with a thin coating of tin. The steel ranges in thickness from about one to about ten mm. The tin ranges in thickness from foil thinness to that of a few millimeters. In turn, the tin is over-molded with a fine layer or coating of a non-conductive material, such as polypropylene or polyethylene. The coating ranges up to about 1.5 mm. Similarly, too, the nose piece is formed of a non-conductive material, such as polypropylene or polyethylene. Alternatively, the fine coating is eliminated and coatings on the plates are subsumed within the materials of the nose piece.

Figure 3:
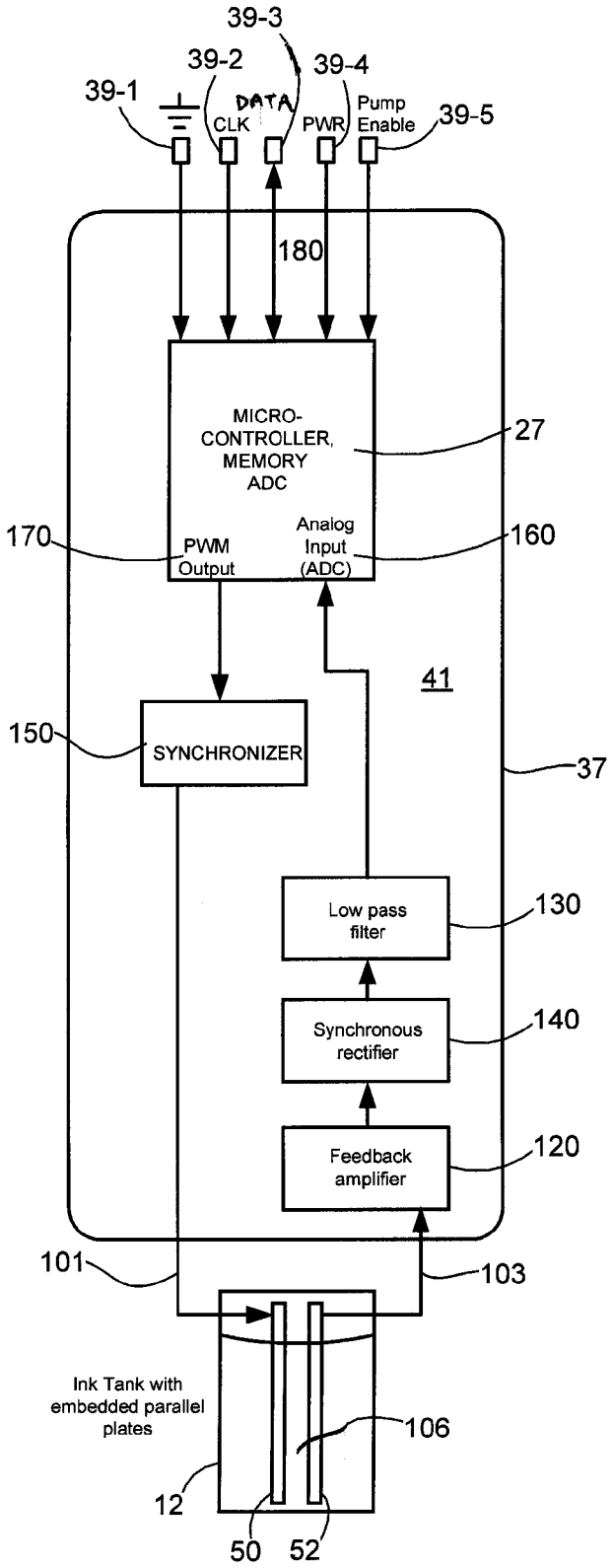
FIG. 3 is a diagrammatic view showing operation of the supply item.

The plates electrically connect to the controller 27 on the backside 41 of the board 37 by way of conductive prongs 45, 43. The prongs extend through the nose piece. With reference to FIG. 3, the controller 27 energizes 101 one electrode of the pair of opposed electrodes and receives an output reading 103 from the other electrode of the pair of electrodes. The output reading corresponds to the amount of liquid 106 existing between the opposed electrodes. The output reading is provided from the supply item to the imaging device to inform the imaging device of how much fluid resides in the supply item. No longer is it necessary for the imaging device to undertake calculations or provide stimulus to ascertain fluid levels.

Also, on board processing of the output reading is undertaken at the supply item before supplying to the imaging device. First, an amplifier 120 is used to increase a signal level of the output reading. This improves signal to noise ratios of the output reading. Second, the amplified signal is filtered at 130 to eliminate further extraneous noise. At 140 and 150, a synchronous rectifier and synchronizer act in concert to coordinate the frequencies of the input 101 and output 103 that reside on opposite electrodes 50, 52 of the electrode pair. At 170, the controller 27 supplies the input 101 as a pulse width modulated square wave. At 160, a converter changes the output reading from an analog reading back into a digital signal. As a noted advantage, keeping together the components of this system on the supply item allows for co-location of analog components and short lengths of electrical traces. In turn, electromagnetic radiation is kept at a minimum as is electrical susceptibility to noise which is otherwise common in analog circuits. The controller 27 also alters the digital signal into a digital data stream (16 bit) for supplying to the imaging device on (data) pad 39-3.

On other pads, power and ground 39-1, 39-4 are made common between the supply item 10 and the imaging device. Similarly, a clock is provided from the imaging device at pad 39-2 to synch the signals received from the controller 27.

At pad 39-5, a pump enable output is provided to the imaging device from the supply item. Appreciating that some imaging devices will have fluid recirculation systems, the enable output allows operation or not of a fluid pump in the imaging device. The concept is to prevent spilling over fluid in the imaging device by operation of a fluid pump, until such time as a supply item is properly installed and can receive return fluid, such as at port 11 (FIG. 1B). It sets proper installation and authentication of a supply item as a condition precedent to operating the pump in the imaging device. Once the supply item 10 is properly seated, its pin 39-5 will connect to a corresponding pin in an imaging device. Upon application of ground and power, the controller 27 communicates with a controller in the imaging device. If both the controller and the imaging device agree that authentication between the two devices is proper, the controller 27 will pull the enable output from a voltage high to a voltage low (or alter voltage vice versa as a function of design) at which time the pump in the imaging device will be enabled to operate. The controller in the imaging device then makes the pump work or not as the situation dictates. On the other hand, if authentication is not proper, the controller 27 keeps the enable output 39-5 at a voltage high and the pump in the imaging device is prevented from ever operating. Alternatively, if the supply item is not properly seated, ground and power will fail their appropriate connections and the controller will be unable to set any appropriate voltage level on output pad 39-5.

Figure 4:
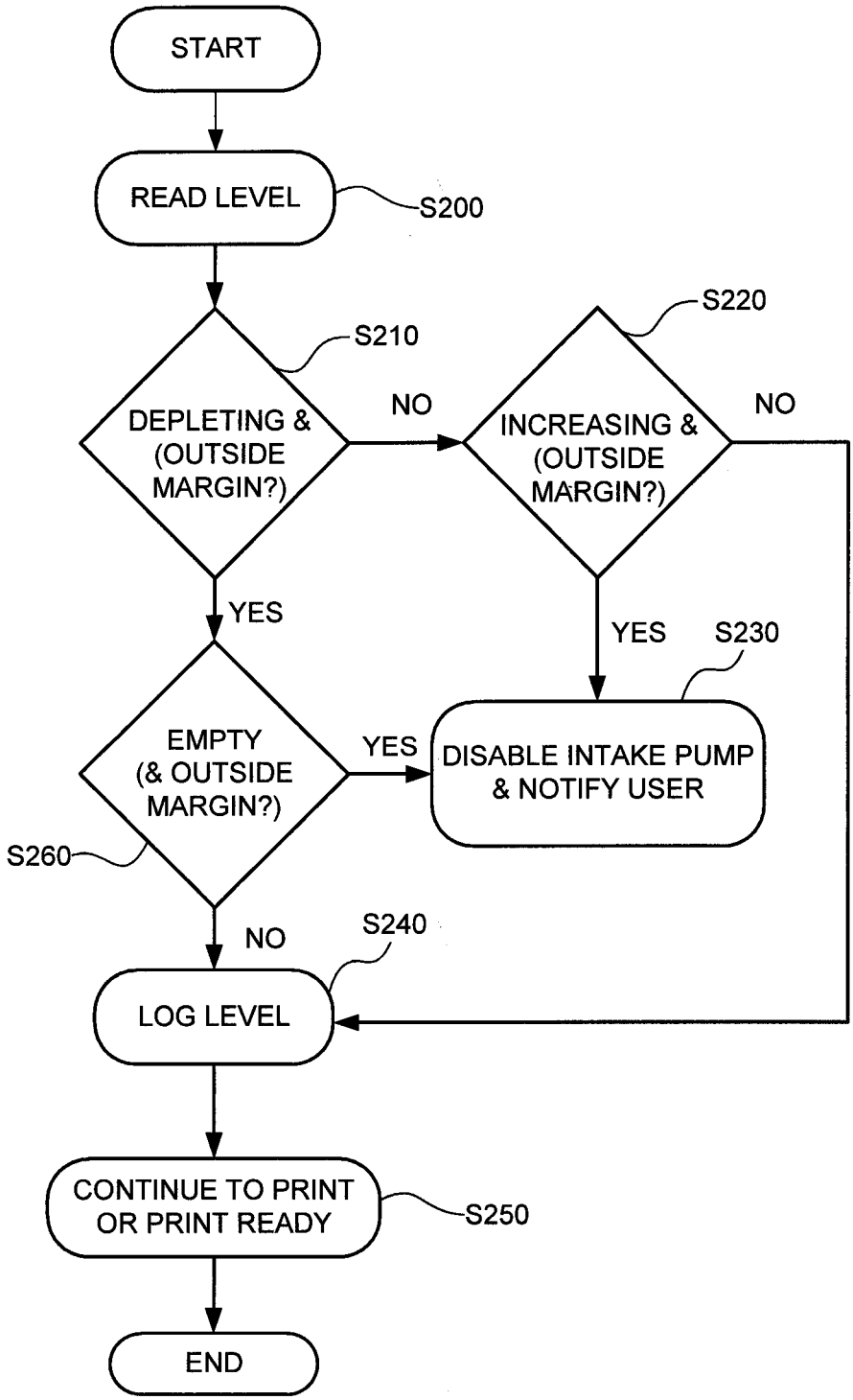
FIGS. 4 and 5 are flow charts for measuring fluid in the supply item and making calibrations.

The controller 27 of the supply item and the controller of the imaging device also coordinate with one another to ascertain fluid levels in the supply item at any given point in time. With reference to FIG. 4, an output reading of a present fluid level in the supply item is read at S200. This includes the controller energizing one of the electrodes of the pair of electrodes and taking an output reading at the other electrode. It also includes communicating the output reading to the imaging device, such as on pad 39-3. If this is a first reading, the supply item should register full or the level set by the manufacturer at the time of manufacturing. If this is a second or later reading, the controller of the supply item or that of the imaging device can determine whether the output reading corresponds to a fluid level in the supply item that is depleting, increasing, maintaining a current level or is empty. (There may be also provided an acceptable operating margin to account for small variations in fluid level readings that are insignificant, such as those due to limited amounts of evaporation or minor tilt of the supply item/imaging device.) At S210, the controller first ascertains whether the fluid level is depleting, such as by noting decreasing values corresponding to the output reading 103 (FIG. 3).

If the fluid level is not depleting at S220, it may be the situation that the fluid level is increasing, such as if a major tilt were introduced in the imaging device and fluid greatly filled the space between the electrodes. In such a circumstance, the pump of the imaging device should be turned off or otherwise made disabled and the user notified, S230. This prevents fluid spill in the imaging device or other unfortunate consequences, such as de-priming ejection heads, cross contaminating the inks at the ejection head, or ingesting air in liquid channels. The disabling of the pump occurs by the controller altering the voltage level on the enable output pad 39-5 back to voltage high. Notifications to the user occur by way of display screen messages, audible alarms, visual light patterns, or the like. On the other hand, if the fluid level at S220 were not found to be increasing, the present fluid level may the same as an earlier fluid level and operation of the imaging device can continue unabated. The new level can also be logged, time stamped, etc. at S240. The logging can occur in the controller 27 by writing back to memory the present fluid level. Alternatively, or in addition, the present fluid level can be stored in the imaging device. In either, the imaging device remains available to users for printing at S250.

At S260, if the fluid level is actually depleting at S220, the controller determines whether the supply item is empty. If so, the pump is again disabled to prevent problems in the imaging device and the user is notified at S230. If the supply item is not empty, but simply depleting, the new lower level of fluid is logged at S240 and the imaging device is maintained available for printing at S250.

Figure 5:
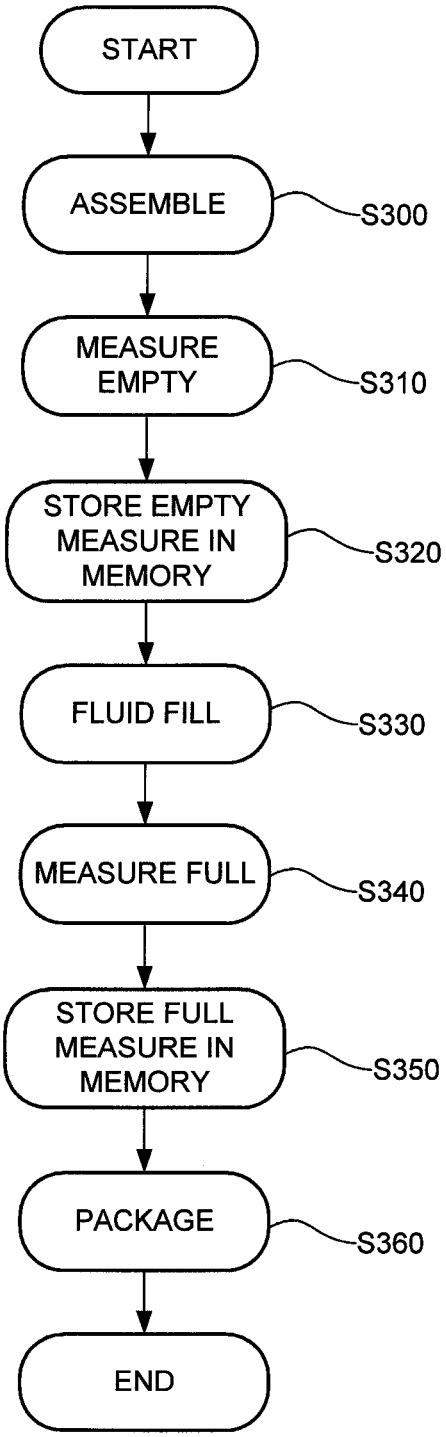

With reference to FIG. 5, each supply item from production will have its own unique capacitance readings indicating empty and fluid full. Owing to common calibration schemes in imaging devices, all supply items should be calibrated at common times during manufacturing to eliminate variations in calculations that increase the difficulty of fluid level measurement. As proposed here, each supply item will be calibrated after final assembly (S300) by taking output readings of its electrodes under both a completely empty (S310) and full level conditions (S330/S340). Values obtained for the empty and full conditions will be stored in the memory (S310/S350) associated with the controller aboard the supply item. At S360, the supply item will be packaged shut and shipped to final destinations for use by users.

Upon installation in an imaging device, the imaging device can use the empty and full condition values read from memory of the supply item to calibrate its expectations of readings supplied to it from the supply item. For instance, if a full condition for a first supply item corresponded to 11.0 pf and an empty condition corresponded to 1.0 pf, the imaging device could set an expectation of a half full supply item to occur around 6.0 pf, or halfway between 11.0 pf and 1.0 pf. Conversely, if a later installed second supply item had full and empty values corresponding to 11.5 pf and 1.5 pf, the half full supply item would be expected by the imaging device to occur at 6.5 pf, which is halfway between the 11.5 pf and 1.5 pf readings. In any scheme, this process eliminates fluid fill variations that are due to one or more of the following (but not limited to): manufacturing fill tolerances; variations in the dimensions/volume of the supply item; variations in fluid composition from one batch to a next; variations in electrical components and electrodes from one supply item to the next; and variations owing to future implementations of fluid, materials, electronics, or the like.

As part of the overall assembly at S300, each of the opposed electrodes 50, 52 (FIGS. 1A-2) is a conductive plate that extends outward from the nose piece 33 in at least two locations. At a first of the locations, the plates have prongs 43, 45 that are used to energize the electrodes (101) or take output readings (103), as described above. The prongs are fairly fragile and define a relatively small rectangular or cylindrical cross section that extends outward from the nose piece for a few millimeters. At a second of the locations, the plates have a more durable section of plate 57 that is used to grasp each electrode with a pick tool during manufacturing so that they can be plated, coated and held stationary as the nose piece is formed. In the present design, each electrode also has two durable sections of plate 57, one above the other, that are used to manipulate the electrode during assembly.

In still other considerations of the electrodes, fluid level detection is improved as signal to noise ratios are increased. To achieve this, the plates of the electrodes are entirely conductive and made as large as practicable. The plates are also made the same shape and placed parallel to one another inside the interior 14 of the housing 12 as seen in FIG. 1C, for example. However, difficulties can arise from placing and energizing conductive (metal) plates directly in a source of fluid.

Firstly, charges on the metal cause constituents to flocculate out of the fluid and collect on the plates, especially with pigment based inks. This collection causes degradations over time in the strength of signal of output readings (103) of the electrodes. Secondly, stainless steel remains durable in liquid, but is relatively expensive. A preferred solution, therefore, is embedding the plates within a non-conductor, such as a plastic housing, which allows the plates to charge without attracting fluid ingredients and prevents direct contact with fluid, thereby enabling a vaster selection of materials beyond that of stainless steel. In turn, cheaper materials are available as are materials that can be soldered into electrical communication in a circuit, unlike stainless steel.

A mold over the plates also enables the precise placement of the non-conductor, but also controls plate to plate spacing within prescribed molding tolerances, keeps the plates in one single, modular piece to reduce part variations, and minimizes air gaps between the plates which leads to distorted fluid level readings. In addition, the use of an over-molded design preserves plastic tool life by reducing the risk of thin steel conditions (that could exist from forming pockets to press-fit the plates) and allows for lengthier plates, thus larger surface area that increases signal strength.

Relatively apparent advantages of the many embodiments include, but are not limited to: (1) a supply item having self-contained fluid level detection device, including on-board processing, memory and digital messaging; (2) pump enable or disable dictated by the supply item; (3) a calibration process for empty/full levels of the supply items during manufacturing yielding calibration of individual imaging devices; (4) fluid level detection using capacitive plates inside the fluid to increase accuracy; (5) modular designs facilitating mass production, ease of circuit placement, and compatibility with multiple fluid filling levels and volume sizes.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. Relatively apparent modifications include combining one or more features of various embodiments with features of other embodiments.

The invention claimed is:

1. A consumable supply item for an imaging device to hold an initial or refillable volume of liquid, comprising:

a housing defining an interior to retain the volume of liquid;

a pair of opposed electrodes attached to the housing having a capacitance that varies in response to an amount of liquid existing between the opposed electrodes; and a controller on the housing configured to provide a pump enable output to a pump of the imaging device upon connection of the controller to the imaging device when the consumable supply item is properly seated in the imaging device, the pump enable output being a condition precedent to subsequent operation of the pump by an imaging device controller based on an output reading from one electrode of the pair of opposed electrodes, the output reading corresponding to said amount of liquid existing between the opposed electrodes that the controller supplies during use to the imaging device.

2. The supply item of claim 1, further including an amplifier to increase a signal level of the output reading before the controller supplies it to the imaging device.

3. The supply item of claim 1, further including a memory storing calibration values for said imaging device corresponding to a capacitance reading of said housing being empty and full of said initial or refillable volume of liquid.

4. The supply item of claim 1, further including a converter to change the output reading into a digital data stream for the controller to supply to the imaging device.

5. The supply item of claim 1, wherein the controller is further configured to determine whether a present output reading represents a depletion or an increase of liquid in the housing over time and to set the enable output in accordance therewith.

6. The supply item of claim 1, wherein each of the opposed electrodes is tin plated steel.

7. The supply item of claim 1, wherein each of the opposed electrodes is a conductive material coated with a non-conductive material.

8. The supply item of claim 7, wherein the conductive material extends outward from the non-conductive material in at least two locations, a first of the locations being used to grasp the each of the opposed electrodes during coating and a second of the locations for said energizing or receiving the output reading.

9. The supply item of claim 7, wherein the non-conductive material is polypropylene or polyethylene.

10. The supply item of claim 1, wherein the opposed electrodes are plates substantially parallel to one another.

11. A consumable supply item for an imaging device to hold an initial or refillable volume of liquid, comprising:

a housing defining an interior to retain the volume of liquid;

a modular front piece attached to the housing having a pair of opposed electrodes vertically oriented in the interior of the housing to capacitively measure an amount of liquid in the interior existing between the opposed electrodes; and a controller on the modular front piece configured to provide a pump enable output to a pump of the imaging device upon connection of the controller to the imaging device when the consumable supply item is properly seated in the imaging device, the pump enable output being a condition precedent to subsequent control of the pump by an imaging device controller based on an output reading from one electrode of the pair of opposed electrodes, the output reading corresponding to said amount of liquid existing between the opposed electrodes that the controller supplies to the imaging device during use.

12. The supply item of claim 11, wherein the modular front piece further includes a fluid exit and return port in vertical alignment adjacent the pair of opposed electrodes, the modular front piece connecting to a front of the housing for the fluid exit and return ports to interface with the imaging device as the housing fronts the imaging device as oriented during use.

13. The supply item of claim 12, wherein the modular front piece further includes an air venting port.

14. The supply item of claim 11, wherein the modular front piece defines a non-conductive material welded to the housing and each of the opposed electrodes is a conductive plate that extends outward from the non-conductive material in at least two locations, a first of the locations being used to grasp the each of the opposed electrodes during manufacturing and a second of the locations for said energizing or receiving the output reading.

15. The supply item of claim 11, further including a memory on the modular front piece storing calibration values for said imaging device corresponding to a capacitance reading of said housing being empty and full of said initial or refillable volume of liquid.

16. The supply item of claim 11, wherein the controller is further configured to determine whether a present reading of the output reading of the other electrode of the pair of opposed electrodes represents a depletion or an increase of liquid in the housing over time and to set the enable output in accordance therewith.

17. The supply item of claim 11, further including a converter to change the output reading into a digital data stream for the controller to supply to the imaging device.

18. A consumable supply item for an imaging device to hold an initial or refillable volume of liquid, comprising:

a housing defining an interior to retain the volume of liquid;

a modular front piece attached to the housing having a pair of opposed electrodes vertically oriented in the interior of the housing to capacitively measure an amount of liquid in the interior existing between the opposed electrodes;

a controller on the modular front piece configured to provide a pump enable output to a pump of the imaging device upon connection of the controller to an imaging device when the consumable supply item is properly seated in the imaging device, the pump enable output being a condition precedent to subsequent control of the pump by an imaging device controller based on an output reading from one electrode of the pair of opposed electrodes, the output reading corresponding to said amount of liquid existing between the opposed electrodes that the controller supplies to the imaging device during use; and a memory on the modular front piece storing calibration values for said imaging device corresponding to a capacitance reading of said housing being empty and full of said initial or refillable volume of liquid, the controller configured to write back to the memory a present fluid level measured by the pair of opposed electrodes and obtained from the output reading during use.

* * * * *